US012504223B2

(12) United States Patent
Akalan et al.

(10) Patent No.: US 12,504,223 B2
(45) Date of Patent: Dec. 23, 2025

(54) COOLING DEVICE WITH A CENTER PILLAR AND A RAIL FIXATION ASSEMBLY

(71) Applicant: BSH Hausgeräte GmbH, Munich (DE)

(72) Inventors: Yigit Akalan, Knoxville, TN (US); Mesut Faruk Cömert, Istanbul (TR); Ozan Özdemir, Tekirdag (TR)

(73) Assignee: BSH Hausgeräte GmbH, Munich (DE)

( * ) Notice: Subject to any disclaimer, the term of this patent is extended or adjusted under 35 U.S.C. 154(b) by 128 days.

(21) Appl. No.: 18/357,588

(22) Filed: Jul. 24, 2023

(65) Prior Publication Data

US 2024/0035738 A1 Feb. 1, 2024

(51) Int. Cl.

| | |
|---|---|
| ***F25D 25/02*** | (2006.01) |
| ***A47B 88/43*** | (2017.01) |
| ***F25D 23/06*** | (2006.01) |

(52) U.S. Cl.

CPC ..... *F25D 25/025* (2013.01); *A47B 88/43* (2017.01); *F25D 23/067* (2013.01); *A47B 2210/175* (2013.01); *F25D 2323/021* (2013.01)

(58) Field of Classification Search

CPC .... F25D 25/025; F25D 23/065; F25D 23/067; A47B 2210/175; A47B 88/43

See application file for complete search history.

(56) References Cited

U.S. PATENT DOCUMENTS

| | | | | |
|---|---|---|---|---|
| 10,006,693 | B2 | 6/2018 | Ramm et al. | |
| 2017/0115050 | A1* | 4/2017 | Ramm | F25D 25/025 |
| 2017/0115051 | A1* | 4/2017 | Ramm | F25D 25/025 |
| 2017/0122653 | A1* | 5/2017 | Cizik | F25D 25/025 |
| 2017/0227280 | A1* | 8/2017 | Yang | F25D 11/02 |
| 2018/0187944 | A1* | 7/2018 | Park | F25D 11/025 |
| 2018/0313601 | A1* | 11/2018 | Sert | F25D 25/025 |

FOREIGN PATENT DOCUMENTS

| | | | | |
|---|---|---|---|---|
| CN | 202267292 U | * | 6/2012 | |
| CN | 115307357 A | * | 11/2022 | |
| KR | 20230000136 U | * | 1/2023 | F25D 25/025 |

* cited by examiner

*Primary Examiner* — Kimberley S Wright
(74) *Attorney, Agent, or Firm* — Laurence A. Greenberg; Werner H. Stemer; Ralph E. Locher

(57) ABSTRACT

A cooling device has a cabinet with at least one storage compartments for storing foodstuffs. At least two drawer doors are movable between a closed position for closing the cabinet and an open position for allowing access to the storage compartment. A center pillar extends vertically between a ceiling and a base of the storage compartment such that the drawer doors are in contact with the center pillar for sealing the storage compartment when the drawer doors are closed. A rail fixation assembly for connecting at least one rail extends between the center pillar and a rear wall. The rail fixation assembly has a pair of brackets extending from the center pillar towards the rear wall. The brackets are being spaced apart in the vertical direction, with a first bracket configured to connect to the ceiling and a second bracket configured to connect to the base.

13 Claims, 7 Drawing Sheets

COOLING DEVICE WITH A CENTER PILLAR AND A RAIL FIXATION ASSEMBLY

CROSS-REFERENCE TO RELATED APPLICATION

This application claims the priority, under 35 U.S.C. § 119, of Turkish patent application TR 2022/011865, filed Jul. 26, 2022; the prior application is herewith incorporated by reference in its entirety.

FIELD AND BACKGROUND OF THE INVENTION

The present invention relates to a cooling device comprising a cabinet having two side walls and a rear wall. At least one storage compartment for storing foodstuffs is provided in the cabinet. At least two drawer doors are coupled to the cabinet and movable between a closed position for at least partly closing the cabinet and an open position for allowing access to the storage compartment. A center pillar in the cabinet extends vertically between a ceiling and a base. The drawer doors are in contact with the center pillar for sealing the storage compartment when the drawer doors are in the closed position. A rail fixation assembly on which at least one rail can be connected is disposed between the center pillar and the rear wall.

In at least one aspect, a cooling device comprises a rear wall and plurality of side walls in order to define a storage compartment. There is a need for dividing the storage compartments in cooling devices having large storage compartments in order to use the area efficiently. In the state of the art, the storage compartment is divided into the sub compartments by a center vertical mullion. The rails are defined on the center vertical mullion. A first drawer is slidably engaged with first rail and a second drawer slidably engaged with the second rail.

U.S. Pat. No. 10,006,693 B2 discloses a refrigerating appliance that includes an interior volume divided by a medial wall into refrigerating and freezing compartments. A horizontal false mullion extends through one of the compartments, parallel with the medial wall to define a pantry compartment in thermal communication with at least one of the refrigerating and freezing compartments. A center vertical mullion is removably engaged with the medial wall and divides the pantry compartment into first and second pantry sub compartments. First and second outer drawer glides are positioned on the cabinet structure within the pantry compartment and opposite first and second inner drawer glides of the center vertical mullion. The first inner and first outer drawer glides partially define the first pantry sub compartment. The second inner and second outer drawer glides partially define the second pantry sub compartment. First and second pantry drawers are slidably engaged with first and second pantry sub compartments, respectively.

SUMMARY OF THE INVENTION

It is an object of the invention to provide a cooling device which overcomes a variety of disadvantages of the heretofore-known devices and which provides for a cooling device with a rail fixation assembly that provides solid rail fixation.

With the above and other objects in view there is provided, in accordance with the invention, a cooling device, comprising:

a cabinet having side walls and a rear wall;

at least one storage compartment having a ceiling and a base provided in said cabinet for storing foodstuffs;

at least two drawer doors mounted to said cabinet and movable between a closed position for at least partly closing the cabinet and an open position for allowing access to the storage compartment;

a center pillar extending in a vertical direction between said ceiling and said base of said at least one storage compartment, wherein said drawer doors are in contact with said center pillar for sealing said storage compartment when said drawer doors are in the closed position;

a rail fixation assembly for connecting at least one rail thereto, said rail fixation element being disposed between said center pillar and said rear wall of said cabinet, and having a pair of brackets extending from said center pillar towards said rear wall; and said pair of brackets having a first bracket and a second bracket spaced apart from one another in the vertical direction, with said first bracket being configured to connect to said ceiling and said second bracket being configured to connect to said base.

In other words, the above and other objects are achieved by the invention by way of a cooling device with two or more drawer doors (i.e., drawer-type doors, or drawer front panels) coupled to the cabinet and movable between a closed position for at least partly closing the cabinet and an open position for allowing access to the storage compartment, and a center pillar extending in a vertical direction between the ceiling and the base, such that the drawer doors are in contact with the center pillar for sealing the storage compartment when the drawer doors are in the closed position. A rail fixation assembly whereon at least one rail can be connected is provided between the center pillar and the rear wall. The rail fixation assembly comprises a pair of brackets extending from the center pillar towards the rear wall, and wherein the pair of brackets are being spaced apart each other in the vertical direction such that the first bracket is configured to connect to the ceiling and the second bracket is configured to connect to the base. Therefore, the brackets are firmly connected and fixed. Rigidity of the brackets is improved. Thus, solid rail fixation assembly is provided. Thus, wobbling of the drawer door is prevented when the drawer door is moved.

The first bracket is configured to be connected to the center pillar. Therefore, the first bracket is connected to the ceiling from one side and to the center pillar from another side. Thus, the fixation strength of the first bracket is improved.

A first rail housing is provided on the first bracket for connecting a first rail to the first bracket. Therefore, placing the first rail on the first bracket is facilitated. Thus, mounting the first rail to the first bracket is simplified.

A first rail connection hole is provided on the first rail housing. Therefore, connecting the first rail to the first bracket with a mounting member such as a screw is provided in order to improve the rigidity of mounting.

The first bracket has an upper connection portion extending parallel to the ceiling. The upper connection portion defines a substantially planar mounting surface for mounting. Therefore, connecting the first bracket to the ceiling is made easier.

At least one upper connection hole is provided on the upper connection portion. Therefore, hanging the first bracket to the ceiling of the storage compartment is provided.

The first bracket has a side connection portion, or lateral portion, extending to the center pillar. Thus, connecting the first bracket to the center pillar is made easier.

At least one side connection hole is provided on the side connection portion and wherein at least one respective first bracket mounting hole is provided on the center pillar. Therefore, mounting the first bracket to the center pillar with a mounting member such as a screw is provided in order to improve the rigidity of mounting.

The first bracket is formed with at least one first ventilation opening in order that a first sub compartment is in thermal communication with a second sub compartment. Therefore, airflow in the storage compartment is enhanced.

The second bracket has a top wall extending parallel to the base, and two lateral walls facing each other, extending from the top wall to the base in a parallel manner to the side wall. Therefore, rigidity of the second bracket is improved.

A second rail housing is provided on at least one lateral wall for connecting a second rail to the second bracket. Therefore, the second rail is connected on a planar surface easily.

The second bracket is formed with at least one second ventilation opening in order that a first sub compartment is in thermal communication with a second sub compartment. Therefore, airflow in the storage compartment is enhanced.

A base connection portion extending parallel to the base, is provided at the end of the lateral wall. The base connection portion defines a substantially planar mounting surface for mounting. Therefore, connecting the second bracket to the base is made easier.

The center pillar has at least one of a first rail mounting hole for connecting the first rail to the center pillar and a second rail mounting hole for connecting the second rail to the center pillar. Therefore, mounting the first rail and/or the second rail to the center pillar is made easier. Besides, since the rails are mounted both of the brackets and the center pillar, rigidity of the rail fixation assembly is improved.

At least one reinforcement element is provided on a region of the center pillar where the mounting holes are provided. Therefore, the center pillar is supported by the reinforcement element. Thus, the solid rail fixation assembly is provided. The withstand performance of the rail against the loads are enhanced.

Other features which are considered as characteristic for the invention are set forth in the appended claims.

Although the invention is illustrated and described herein as embodied in a cooling device having a center pillar and a rail fixation assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
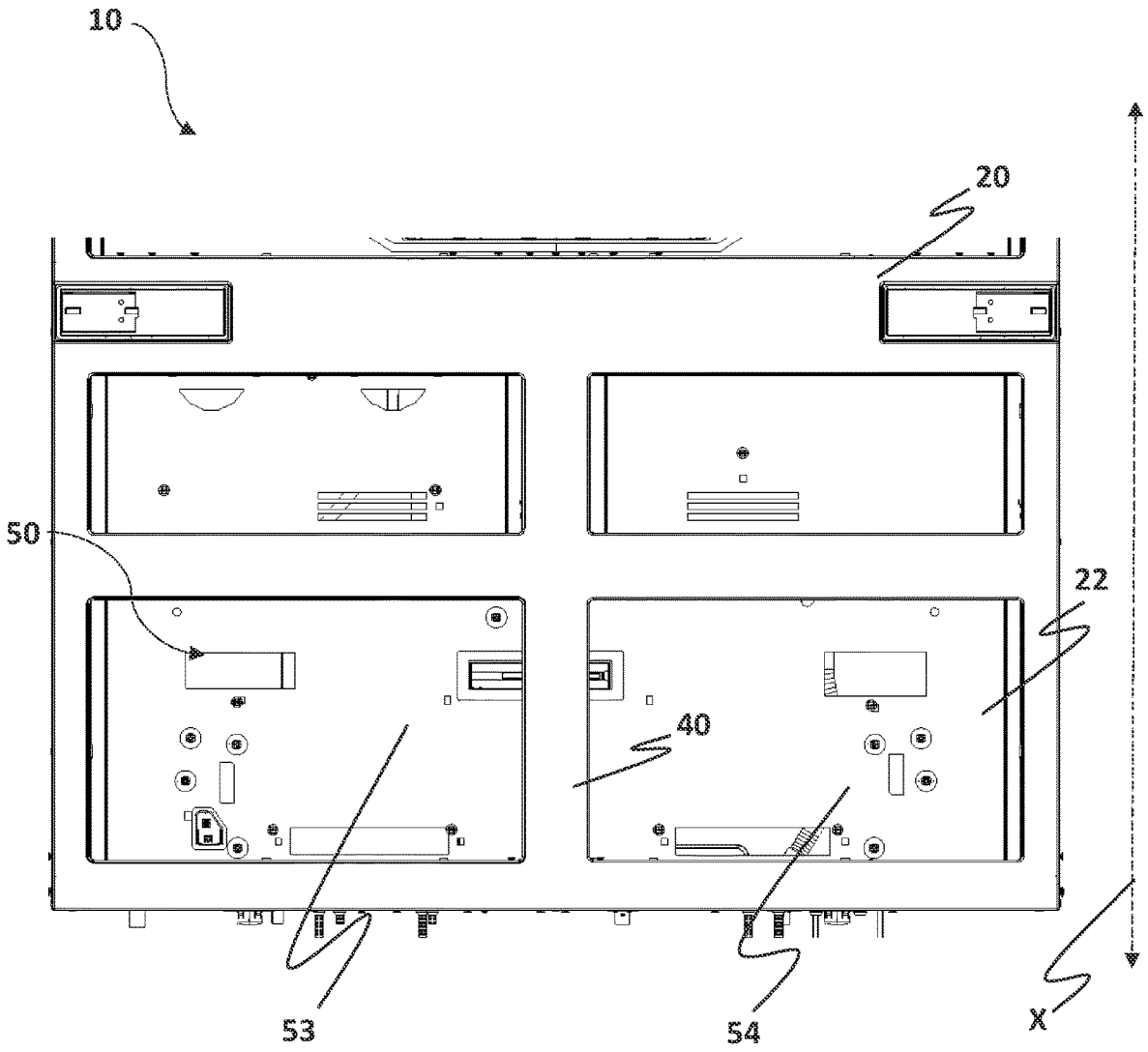
FIG. 1 is a front view of the cooling device, according to the present invention.
Figure 2:
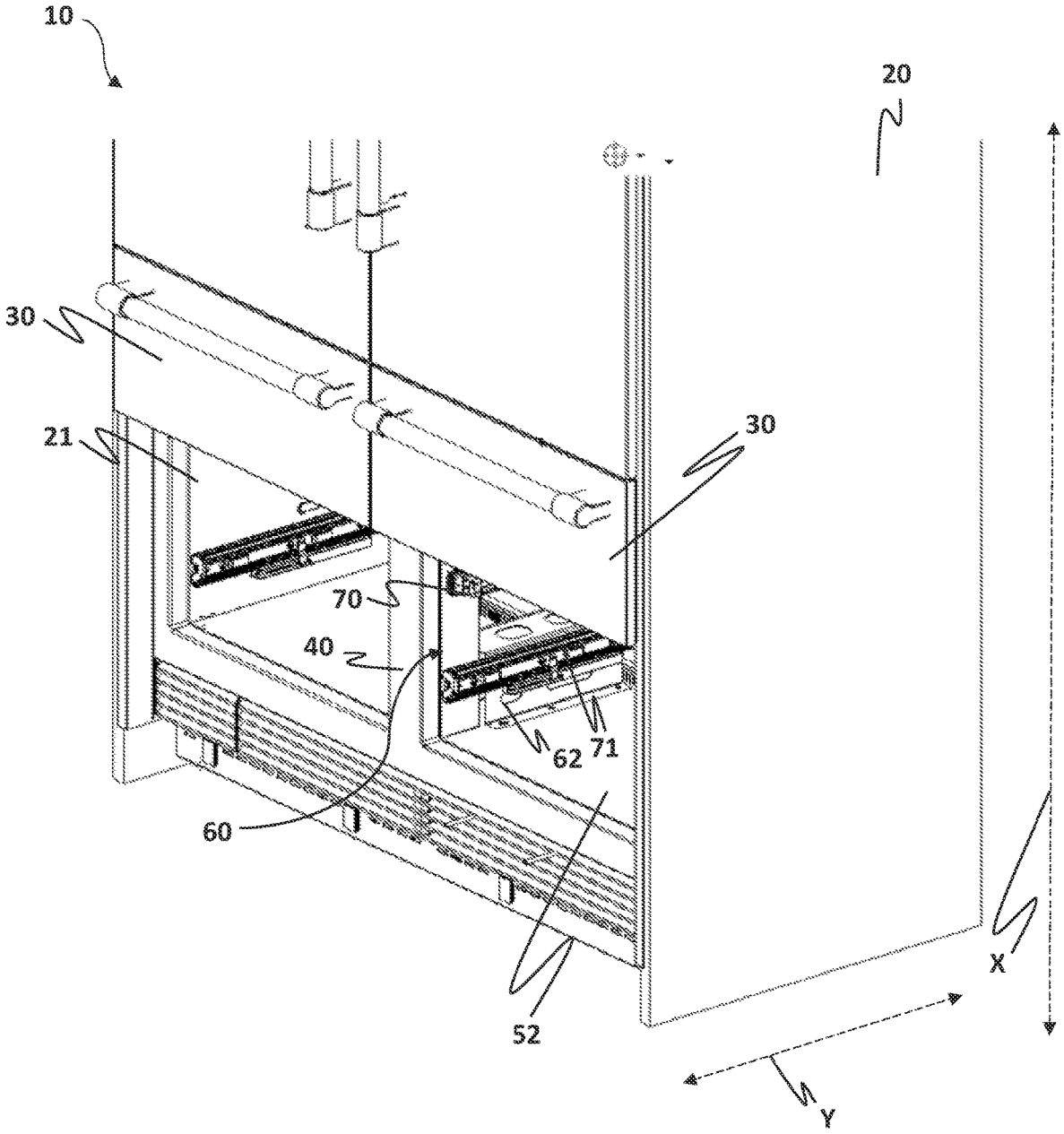
FIG. 2 is a perspective view of the cooling device provided with rails, according to the present invention.

Referring now to the figures of the drawing in detail there is shown a cooling device (10) comprising a cabinet (20) having two side walls (21) and a rear wall (22). Referring to FIG. 1 and FIG. 2, at least one storage compartment (50) having a ceiling (51) and a base (52) is defined by side walls (21) and a rear wall (22). The side walls (21) face towards one another. The ceiling (51) and the base (52) face towards one another. The ceiling (51) and the base (52) are spaced apart from each other in the vertical direction (X). The ceiling (51) and the base (52) are disposed between the side walls (21).

At least two drawer doors (30), i.e., front panels of two drawers, are coupled to the cabinet (20) and movable between a closed position for at least partly closing the cabinet (20) and an open position for allowing access to the storage compartment (50). The drawer door (30) can be pushed towards the cabinet (20) to close the storage compartment (50) and can be pulled outwards to open the storage compartment (50). The backside of the drawer door (30) is connected with a container for containing articles therein. The user may push or pull the container into or out of the storage compartment (50) to get an article contained in the container. The drawer door (30) and the container form a drawer unit which can be pushed into or pulled out of the cabinet (20).

Figure 3:
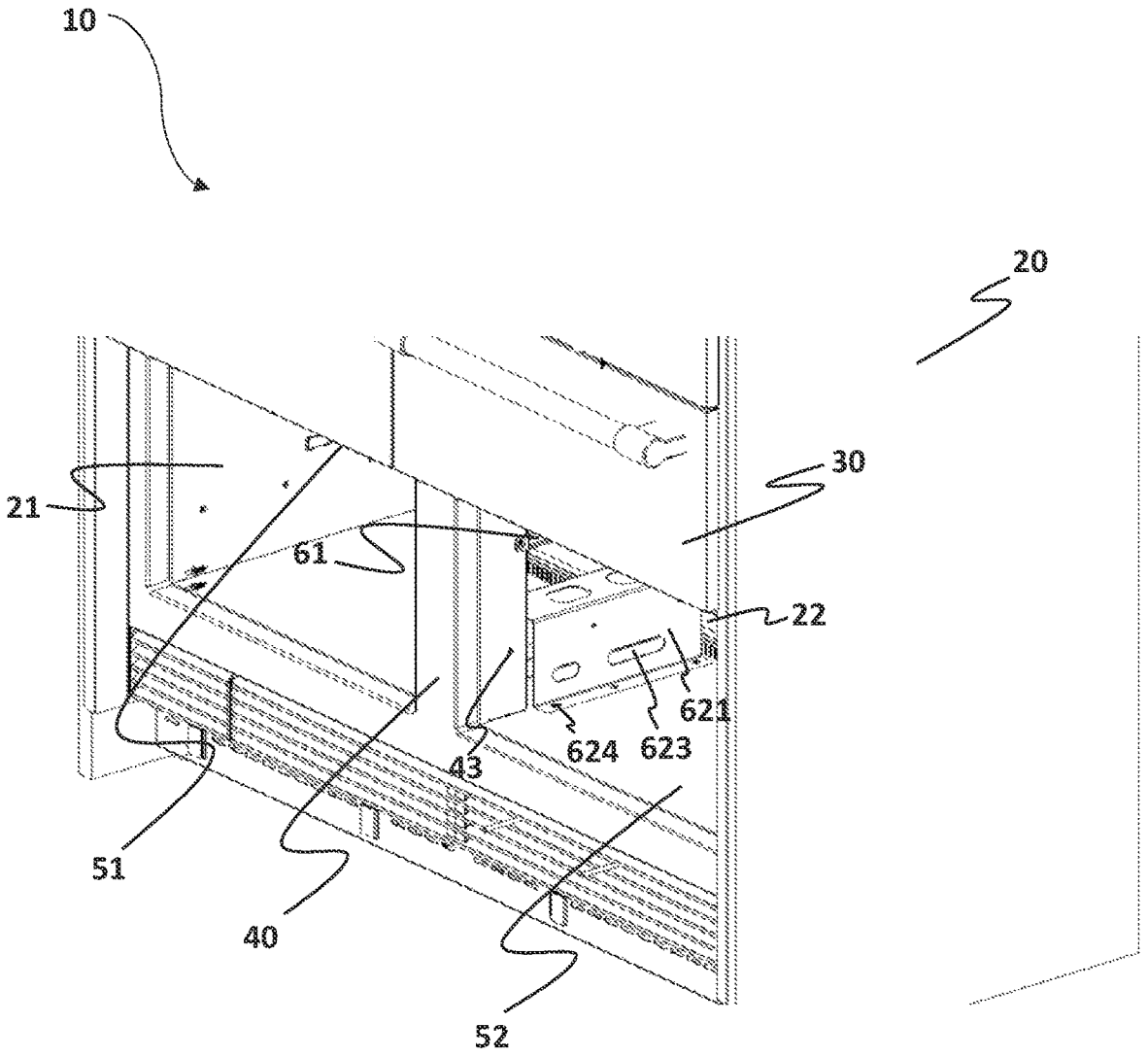
FIG. 3 is a perspective view of the cooling device without rails, according to the present invention.

A center pillar (40) extends in a vertical direction (X) between the ceiling (51) and the base (52), provided in the cabinet (20) such that the drawer doors (30) are in contact with the center pillar (40) for sealing the storage compartment (50) when the drawer doors (30) are in the closed position. As seen in FIG. 1 and FIG. 2, the vertical direction (X) is parallel to a height direction of the cabinet (20). As can be seen in FIG. 1-3, the center pillar (40) is provided in the cabinet (20) so as to be front side of the storage compartment (50) which is opposite the rear wall (22). The center pillar (40) defines a substantially continuous sealing surface for a gasket of the drawer door (30). A rail fixation assembly (60) whereon at least one rail (70,71) can be connected, is provided between the center pillar (40) and the rear wall (22). The rail fixation assembly (60) comprises a pair brackets (61, 62) extending from the center pillar (40) towards the rear wall (22), and wherein the pair of brackets (61,62) are spaced apart from each other in the vertical direction (X) such that the first bracket (61) is configured to connect to the ceiling (51) and the second bracket (62) is configured to connect to the base (52). The brackets (61,62) extend in a width direction (Y) of the cabinet (20). The width direction (Y) is perpendicular to the vertical direction (X).

Referring to FIG. 2 and FIG. 3, the first bracket (61) is placed above a second bracket (62) with respect to the vertical direction (X). Referring to FIG. 2, the first rail (70) is placed on the first bracket (61) and the second rail (71) is placed on the second bracket (62). At least one additional rail (70,71) is provided on the side wall (21) facing the rail fixation assembly (60). A drawer door (30) is slidably engaged with the corresponding rails (70,71). The rail fixation assembly (60) extends from the center pillar (40) to the rear wall (22). The first bracket (61) is connected to the ceiling (51) of the storage compartment (50) from one side. Referring to FIG. 2 and FIG. 3, the second bracket (62) is connected to the base (52) of the storage compartment (50).

The first bracket (61) is connected to the ceiling (51) of the storage compartment (50) from one side and to the center pillar (40) from another side. The first bracket (61) is connected to the center pillar (40) by means of a mounting member. The first bracket (61) is rigidly mounted in the storage compartment (50).

Figure 4:
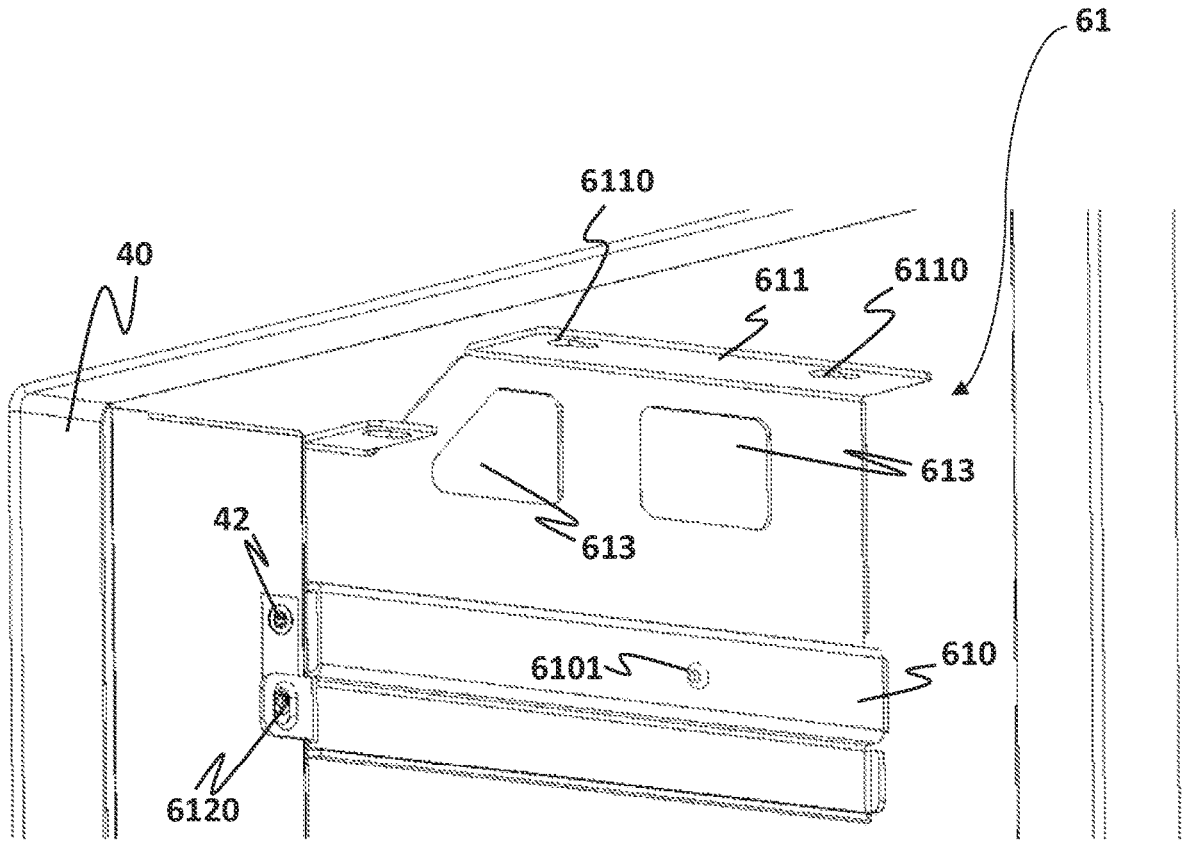
FIG. 4 is a perspective view of the center pillar and first bracket, according to the present invention.
Figure 5:
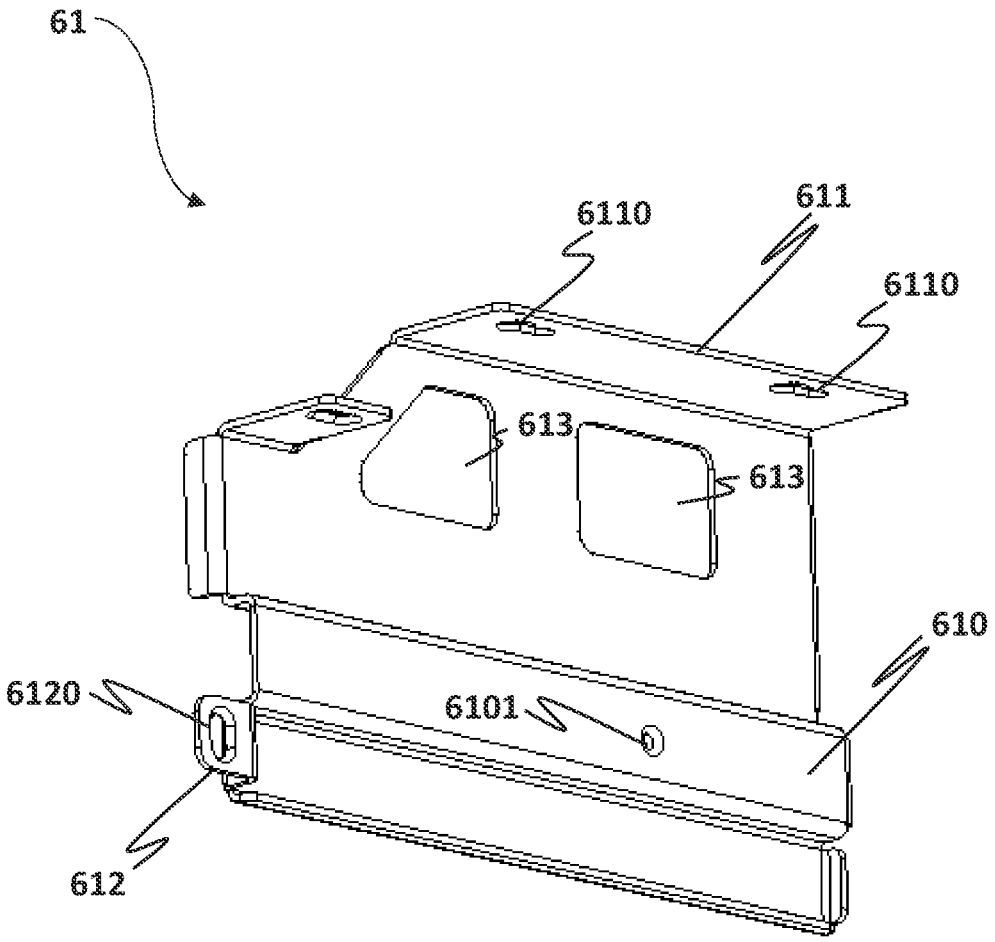
FIG. 5 is a perspective view of the first bracket, according to the present invention.

Referring to FIG. 4 and FIG. 5, a first rail housing (610) is provided on the first bracket (61) for connecting a first rail (70) to the first bracket (61). The first rail housing (610) is in the form of an embossment formed on the first bracket (61). Therefore, rigidity is increased for supporting the first rail (70) and the drawer door (30). The first rail housing (610) extends along the first bracket (61) in a parallel manner to the side wall (21). A first rail connection hole (6101) is provided on the first rail housing (610). The first rail (70) is connected to the first rail connection hole (6101) via a mounting member.

Still referring to FIG. 4 and FIG. 5, the first bracket (61) has an upper connection portion (611) extending parallel to the ceiling (51). The upper connection portion (611) is formed on the upper side of the first bracket (61) facing the ceiling (51) when mounted. The upper connection portion (611) extends to the side wall (21). At least one upper connection hole (6110) is provided on the upper connection portion (611). The upper connection hole (6110) has narrowing cross section. Therefore, after the first bracket (61) is hung on the ceiling (51) from the upper connection hole (6110) via a mounting member, the first bracket (61) may be slidably moved parallel to the side wall (21) when the mounting member is loosened.

As shown in FIG. 4, the first bracket (61) has a side connection portion (612), or lateral connection portion (612), extending to the center pillar (40). The first bracket (61) is connected to the center pillar (40) from the side connection portion (612). At least one side (or lateral) connection hole (6120) is provided on the side connection portion (612) and wherein at least one respective first bracket mounting hole (44) is provided on the center pillar (40). The side connection hole (6120) and the first bracket mounting hole (44) are aligned. Then a mounting member is passing through the holes (6120, 44) and thus the first bracket (61) is connected to the center pillar (40).

Still referring to FIG. 4 and FIG. 5, the first bracket (61) has at least one first ventilation opening (613) in order that a first sub compartment (53) is in thermal communication with a second sub compartment (54). The first ventilation opening (613) may have different shapes. As illustrated, one of the first ventilation openings (613) has a rectangular cross section and the other one has trapezoid cross section.

Figure 6:
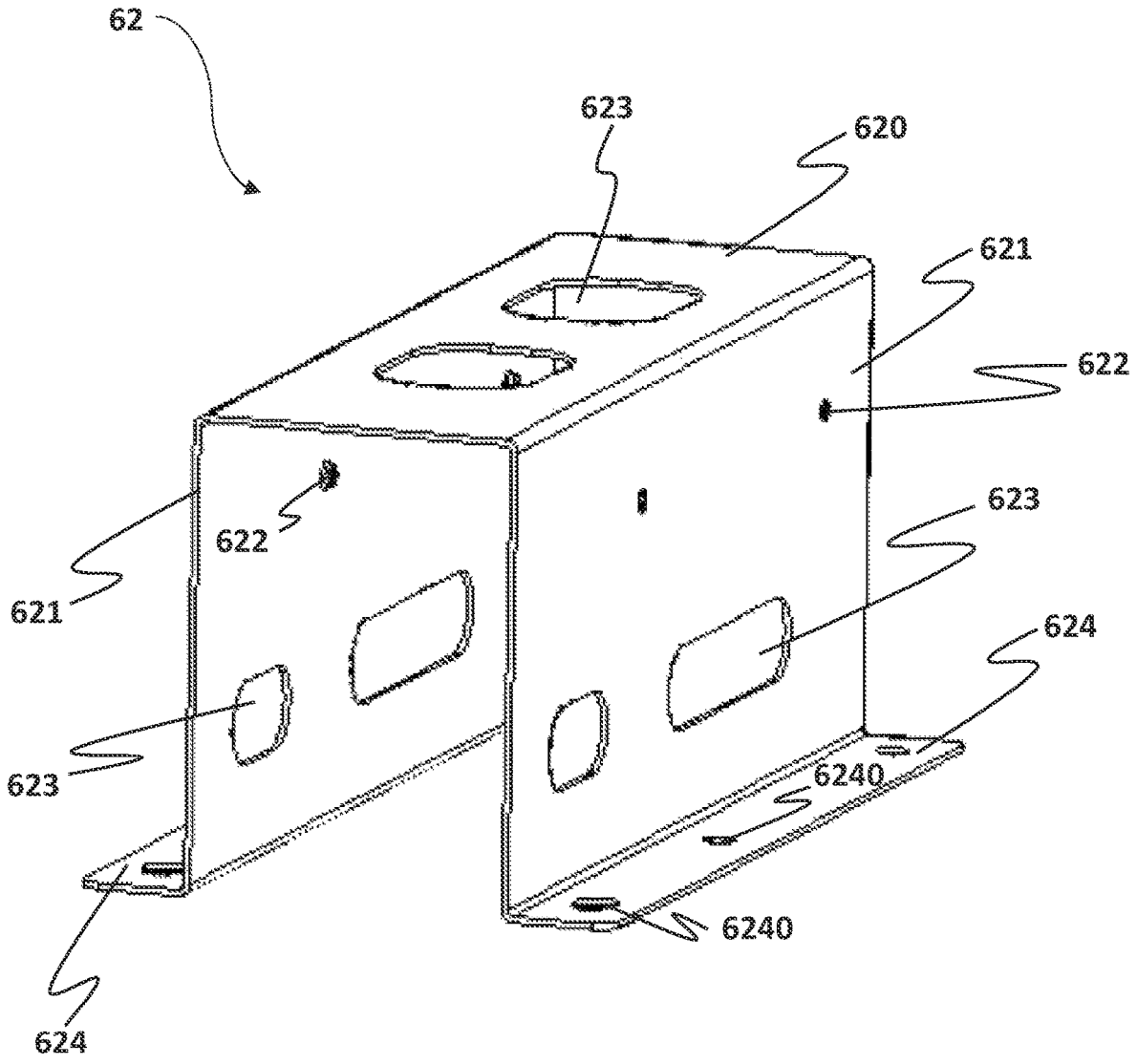
FIG. 6 is a perspective view of the second bracket, according to the present invention.

Referring to FIG. 6, the second bracket (62) has a top wall (620) extending parallel to the base (52), and two lateral walls (621) facing each other, extending from the top wall (620) to the base (52) in a parallel manner to the side wall (21). The second bracket (62) is in the form of reverse U shaped. A second rail housing (622) is provided on at least one lateral wall (621) for connecting a second rail (71) to the second bracket (62). The second rail housing (622) is in the form of a connection opening for mounting the second rail (72). As seen in FIG. 6, two second rail housings (622) are provided on each lateral wall (621) of the second bracket (62).

Still referring to FIG. 6, the second bracket (62) has at least one second ventilation opening (623) in order that a first sub compartment (53) is in thermal communication with a second sub compartment (54). As seen in FIG. 6, two second ventilation openings (623) are provided on each lateral wall (621) and the top wall (620) of the second bracket (62).

Again referring to FIG. 6, a base connection portion (624) extending parallel to the base (52), is provided at the end of the lateral wall (621). The base connection portion (624) has a plurality of base connection holes (6240). The second bracket (62) is connected to the base (52) from the base connection portion (624) via the mounting members passing through the base connection holes (6240).

Figure 7:
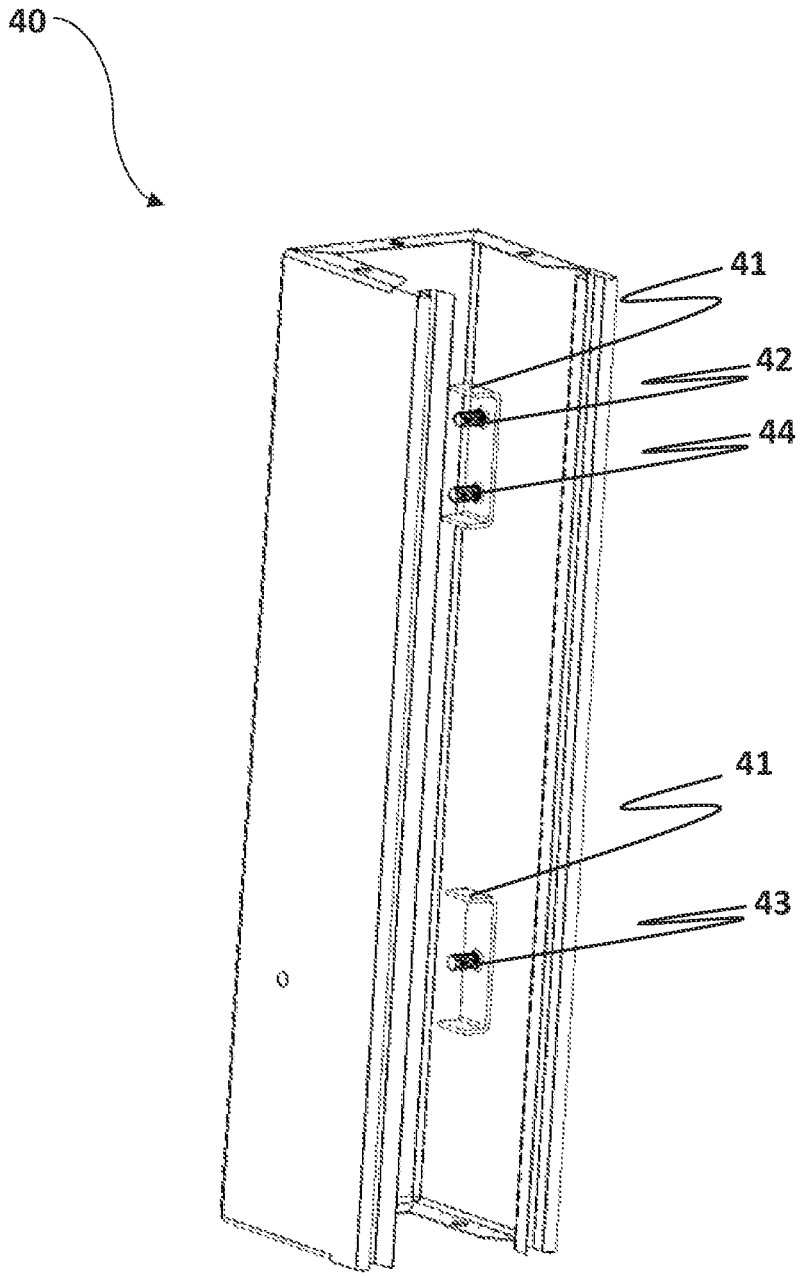
FIG. 7 is a perspective view of the center pillar, according to the present invention.

Referring to FIG. 7, at least one reinforcement element (41) is provided on the center pillar (40). The reinforcement element (41) is a metal sheet. The reinforcement element (41) is provided on the inner wall of the center pillar (40). As seen in FIG. 7, two reinforcement elements (41) are provided on the center pillar (40).

Still with reference to FIG. 7, the center pillar (40) has a first rail mounting hole (42) or a second rail mounting hole (43). The first rail mounting hole (42) is used for connecting the first rail (70) to the center pillar (40). The second mounting hole (43) is used for connecting the first rail (70) to the center pillar (40). In the preferred embodiment of the present invention, the center pillar (40) has a first rail mounting hole (42) and a second rail mounting hole (43). The first rail (70) is connected to the center pillar (40) via a mounting member passing through the first rail mounting hole (42). The second rail (71) is connected to the center pillar (40) via a mounting member passing through the second rail mounting hole (43). At least one reinforcement element (41) is provided on a region of the center pillar (40) where the mounting holes (42, 43, 44) are provided. As seen in FIG. 7, the reinforcement elements (41) are mounted on the center pillar (40) by the mounting members.

The following is a summary list of reference numerals and the corresponding structure used in the above description of the invention:

10 Cooling device
20 Cabinet
21 Side wall
22 Rear wall
30 Drawer door
40 Center pillar
41 Reinforcement element
42 First rail mounting hole
43 Second rail mounting hole
44 First bracket mounting hole
50 Storage compartment
51 Ceiling
52 Base
53 First sub compartment
54 Second sub compartment
60 Rail fixation assembly
61 First bracket
610 First rail housing
6101 First rail connection hole
611 Upper connection portion
6110 Upper connection hole
612 (Lateral) side connection portion
6120 Lateral connection hole
613 First ventilation opening
62 Second bracket
620 Top wall
621 Lateral wall

622 Second rail housing
623 Second ventilation opening
624 Base connection portion
6240 Base connection hole
70 First rail
71 Second rail
X Vertical direction
Y Width direction

The invention claimed is:

1. A cooling device, comprising:

a cabinet having side walls and a rear wall;

at least one storage compartment having a ceiling and a base provided in said cabinet for storing foodstuffs;

at least two drawer doors mounted to said cabinet and movable between a closed position for at least partly closing the cabinet and an open position for allowing access to the storage compartment;

a center pillar extending in a vertical direction between said ceiling and said base of said at least one storage compartment, said center pillar dividing said storage compartment into a first sub compartment and a second sub compartment, wherein said drawer doors are in contact with said center pillar for sealing said storage compartment when said drawer doors are in the closed position;

a rail fixation assembly for connecting at least one rail thereto, said rail fixation element being disposed between said center pillar and said rear wall of said cabinet, and having a pair of brackets extending from said center pillar towards said rear wall; and said pair of brackets having a first bracket and a second bracket spaced apart from one another in the vertical direction forming an opening between said first sub compartment and said second sub compartment vertically between said first bracket and said second bracket, with said first bracket being configured to connect to said ceiling and said second bracket being configured to connect to said base; and a first rail placed on said first bracket and a second rail placed on said second bracket.

2. The cooling device according to claim 1, wherein said first bracket is configured for connection to said center pillar.

3. The cooling device according to claim 1, wherein said first bracket is formed with a first rail housing for connecting a first rail to said first bracket.

4. The cooling device according to claim 3, wherein said first rail housing is formed with a first rail connection hole.

5. The cooling device according to claim 1, wherein said first bracket has an upper connection portion extending parallel to said ceiling of said at least one storage compartment.

6. The cooling device according to claim 5, wherein said upper connection portion is formed with at least one upper connection hole.

7. The cooling device according to claim 1, wherein said first bracket is formed with a lateral connection portion extending to said center pillar.

8. The cooling device according to claim 7, wherein said lateral connection portion is formed with at least one lateral connection hole and wherein said center pillar is formed with at least one respective first bracket mounting hole.

9. The cooling device according to claim 1, wherein said second bracket has a top wall extending parallel to said base, and two lateral walls facing one another, extending from said top wall to said base and parallel to said side wall.

10. The cooling device according to claim 9, wherein at least one lateral wall of said second bracket is formed with a second rail housing for connecting a second rail to said second bracket.

11. The cooling device according to claim 9, wherein an end of said lateral wall is formed with a base connection portion extending parallel to said base.

12. The cooling device according to claim 1, wherein said center pillar is formed with at least one of a first rail mounting hole for connecting a first rail to said center pillar and with a second rail mounting hole for connecting a second rail to said center pillar.

13. The cooling device according to claim 12, which comprises at least one reinforcement element on said center pillar in a region of said center pillar where said mounting holes are formed.

* * * * *